US005957335A

United States Patent [19]

Otto

[11] Patent Number: 5,957,335

[45] Date of Patent: Sep. 28, 1999

[54] APPARATUS FOR PREPARING A MIXTURE OF AN ACTIVE AGENT AND A DILUTING AGENT AND METHOD FOR FILING A CARTRIDGE FOR SUCH APPARATUS

[75] Inventor: Jürgen Otto, Friedrich-Ebert-Strasse 1, 68649 Gross-Rohrheim, Germany

[73] Assignee: Jurgen Otto, Germany

[21] Appl. No.: 08/992,940

[22] Filed: Dec. 18, 1997

[51] Int. Cl.[6] ..... B65B 1/04

[52] U.S. Cl. ..... 222/129; 222/510; 141/100

[58] Field of Search ..... 222/510, 129; 141/2, 9, 18, 381, 100

[56] References Cited

U.S. PATENT DOCUMENTS

| | | | |
|---|---|---|---|
| 3,221,946 | 12/1965 | Riley | 222/510 |
| 3,548,562 | 12/1970 | Schwartzman . | |
| 4,950,237 | 8/1990 | Henault et al. | 222/510 |
| 5,348,060 | 9/1994 | Futagawa et al. | 141/100 |

FOREIGN PATENT DOCUMENTS

| | | |
|---|---|---|
| 0 101 594 | 8/1983 | European Pat. Off. . |
| 0 173 547 | 3/1986 | European Pat. Off. . |
| 0 333 541 | 3/1988 | European Pat. Off. . |
| 0 341 115 | 11/1989 | European Pat. Off. . |
| 2 220 930 | 1/1990 | European Pat. Off. . |
| 2 239 390 | 2/1975 | France . |
| 3535986 A1 | 4/1987 | Germany . |
| WO 81/01400 | 3/1981 | WIPO . |

*Primary Examiner*—Steven O. Douglas

*Attorney, Agent, or Firm*—William B. Kircher; Shook, Hardy & Bacon

[57] ABSTRACT

An apparatus serves for preparing a mixture of an active agent and a diluting agent. A container (45) serves for receiving the diluting agent. A cartridge (10) serves for receiving the active agent (41) within an interior (40) of the cartridge (10) being delimited by wall sections (12, 14, 34). The cartridge (10) is adapted to be inserted into the container (45). It is configured such that the active agent (41) may be discharged into the container (45) and diluted therein with the diluting agent. The cartridge (10), further, has a first wall section (34) adapted to be at least partially disconnected from a surrounding second wall section (14). The first wall section (34) is, further, connected to a third wall section (12) via an actuator (21), the third wall section (12) being separated from the first wall section (34) by the second wall section (14). The actuator (21) is rigidly connected to the third wall section (12) at a fastening point. The third wall section (12) is configured flexibly (30) in the area of said fastening point (FIG. 1).

15 Claims, 1 Drawing Sheet

APPARATUS FOR PREPARING A MIXTURE OF AN ACTIVE AGENT AND A DILUTING AGENT AND METHOD FOR FILING A CARTRIDGE FOR SUCH APPARATUS

BACKGROUND OF THE INVENTION

The invention relates to an apparatus for preparing a mixture of an active agent and a diluting agent, comprising a container for receiving the diluting agent and a cartridge for receiving the active agent within an interior of the cartridge being de-limited by wall sections, the cartridge being adapted to be inserted into the container and being configured such that the active agent may be discharged into the container and diluted therein with the diluting agent, the cartridge, further, having a first wall section adapted to be at least partially disconnected from a surrounding second wall section, the first wall section being connected to a third wall section via an actuator, the third wall section being separated from the first wall section by the second wall section.

The invention, further, is related to a method for filling a cartridge for an apparatus for preparing a mixture of an active agent and a diluting agent, comprising a container for receiving the diluting agent and the cartridge for receiving the active agent within an interior of the cartridge being de-limited by wall sections, the cartridge being adapted to be inserted into the container and being configured such that the active agent may be discharged into the container and diluted therein with the diluting agent, the cartridge, further, having a first wall section adapted to be at least partially disconnected from a surrounding second wall section, the first wall section being connected to a third wall section via an actuator, the third wall section being separated from the first wall section by the second wall section.

An apparatus and a method of the afore-mentioned kind is known from DE-A1-35 35 986.

Apparatuses of the kind mentioned at the outset are used to dilute certain active agents, for example cleaning agents, insecticides, plant-protective agents or the like with an appropriate diluting agent, in particular water, and to distribute the mixture thus prepared, in particular by spraying or vaporizing. The active agent may be a liquid but may also be a powder or a granule.

In particular designs of such apparatuses, bottle-like containers are used having a bottleneck with an outer thread. The bottle-like containers are first filled with a predetermined amount of the diluting agent, for example water. A cartridge of the above-mentioned kind is then inserted into the bottleneck and, finally, a head of a spraying device is screwed thereon which typically also comprises a pump.

During the screwing-on of the head the cartridge is automatically opened so that the active agent from the interior of the cartridge is dispensed into the interior of the container. By agitating the container the active agent is mixed with the diluting agent. The mixture thus prepared may be sprayed by actuating the pump.

It goes without saying that the afore-mentioned design and application examples shall only be understood as an illustration and do not restrict the scope of the present invention.

In the apparatus according to DE-A1-35 35 986, mentioned at the outset, the embodiment described therein uses a cartridge of essentially cylindrical design. The cartridge comprises a hollow-cylindrical pot being open downwardly on one side and having an upper top plate with a circular through-opening. A piston rod is snugly guided through the through-opening and has a piston at its lower free end being simultaneously a closure for the otherwise open lower end of the cylindrical pot.

In a retracted position of the piston rod, the piston closes the pot downwardly so that a wholly enclosed interior of the pot is constituted being filled with an active agent in a first operational position of the cartridge.

For emptying the cartridge, the piston rod is displaced downwardly until the piston is moved out of the lower open end of the cylindrical pot so that an annular opening is created between the cylindrical surface of the pot and the piston rod. The active agent may be dispensed from the cartridge through this annular opening.

For filling the cartridge, the latter is positioned upside down so that the afore-mentioned piston is directed upwardly. By displacing the piston rod the above-mentioned annular opening may be established and the cartridge may be filled according to a predetermined quantity by means of an appropriate filling syringe, when a liquid active agent is used.

The prior art cartridge has the disadvantage that a sealing is required at two locations, namely at the passage of the piston rod and, further, at the outer periphery of the piston. This sealing must be established reliably because active agents sometimes are aggressive media which should not penetrate outwardly prior to their intended use. Further, the prior art cartridges require a complicated manufacture since they must be made with appropriate tight fits and because it is necessary during the assembly of the cartridge to fit the piston with its piston rod relative to the pot.

The prior method has the disadvantage that the cartridge must be filled via an annular opening which requires a complicated manipulation of a filling syringe. In particular, it presents a problem in this case to effect filling with a powder or with a granule.

SUMMARY OF THE INVENTION

It is, therefore, an object underlying the invention to improve an apparatus and a method of the kind specified at the outset such that the above-mentioned disadvantages are obviated. In particular a cartridge being simple in design and in handling shall be made available which is also safe in operation. Finally, the method for filling the cartridge shall be simplified, thus making a cost-effective mass production possible.

According to the apparatus mentioned at the outset, this object is achieved in that the actuator is rigidly connected to the third wall section at a fastening point and that the third wall section is configured flexibly in the area of the fastening point.

The object underlying the invention is thus entirely solved. By the specific design the sealing problem at the connection location between the actuator and the third wall section is obviated. Whereas according to the prior art there was a passage of the piston rod through the top plate of the cartridge, the relative movement of the actuator with respect to the wall sections is effected according to the present invention by making the third wall section flexible in the particular area. The actuator may thus be rigidly connected with the third wall section and must not be configured to slide therein.

By doing so, the above-mentioned leakage problems are drastically minimized. This holds true in particular because the leakage problem in the area of the piston rod passage may not be solved by providing an adhesive foil or the like.

On the other hand, a complicated gasket, for example an O-ring gasket, would result in significantly increased production costs.

According to a method specified at the outset, the object underlying the invention is solved in that the first wall section is detachably connected to the actuator and that the interior, being freely accessible in the absence of the first wall section, is filled with the active agent and thereafter closed by means of the first wall section.

The underlying object is thus also solved because the interior is now freely accessible during the filling of the cartridge so that filling devices of any conceivable kind may be used. In contrast to the prior art it is no more necessary to fill the interior via a narrow annular opening. Instead, the active agent may be filled into the freely accessible interior in the simplest way, for example by pouring. This makes it possible to fill pulverized or granulized active agents under mass production conditions.

In a preferred embodiment of the invention the third wall section is configured as a bellows in the area of the fastening point.

This measure has the advantage that a large relative displacement of the actuator as compared to the wall sections of the cartridge is possible without deteriorating the sealing in the area of the fastening point.

As an alternative, it is possible to configure the third wall section as unextensible diaphragm in the area of the fastening point.

This measure has the advantage, that the third wall section may be manufactured in a simple manner.

In that case it is particularly preferred when the third wall section is configured as a snap mechanism taking a stable end position when the first wall section has been lifted off the second wall section.

This measure has the advantage, that the first wall section, after having exceeded a "snap point" of the snap mechanism will automatically go in its end position allowing a highly lifted-off position of the first wall section. The active agent may then be washed out particularly well because a particularly big circular opening is established. This holds true in particular when a pulverized or granulized active agent is used.

According to other embodiments of the invention the third wall section and the actuator are configured integrally. Moreover, the third wall section and the second wall section may be configured integrally.

These measures have the advantage that simple plastic material injection molding techniques may be used for integrally manufacturing some of the wall sections or all of the wall sections of the cartridge. In such a way the production costs are decreased. In other embodiments of the invention the actuator is configured as a tube penetrating the first wall section.

This measure has the advantage that other media may be guided through the actuator, for example pressurized air may be guided from the ambient atmosphere surrounding the container into its interior or the diluted mixture in the opposite direction.

A particularly good effect is achieved when the first wall section is disconnectably connected to the actuator.

This measure has the advantage that in the manner already mentioned a simple filling of the interior is made possible by filling the interior in the absence of the first wall section, wherein the first wall section is connected thereafter to the actuator and to the second wall section.

This holds true in particular when, according to a further modification of this variant, the first wall section is adapted to be plugged onto the actuator with a snug fit.

This measure has the advantage that the necessary sealing action between the actuator and the first wall section is established in a simple manner.

Furthermore, it is preferred according to the invention when the first wall section is guided within the second wall section in a piston-type manner.

In other embodiments of the invention a foil is provided entirely covering the first wall section and being rigidly connected at its periphery with the second wall section. For that purpose, the second wall section may be configured with an extension.

This measure has the advantage that in the case of particularly aggressive active agents a complete sealing of the interior is possible by, for example, welding or glueing an aluminum-coated foil at its surrounding periphery to the second wall section. The foil may then be destroyed by the advancing piston upon the activation of the actuator.

In the scope of the present invention an embodiment is particularly preferred where the cartridge is designed essentially cylindrically, the first wall section being configured as a bottom plate, the second wall section being configured as a cylindrical wall and the third wall section being configured as a top plate.

The top plate may be provided with a flange at its periphery for attachment to the container.

Further advantages become apparent from the description and the enclosed drawing.

It goes without saying that the afore-mentioned features and those that will be explained hereinafter may not only be used in the particularly given combination but also in other combination or alone without leaving the scope of the present invention.

An embodiment of the invention is shown in the drawing and will be discussed in the subsequent description.

DETAILED DESCRIPTION OF THE INVENTION

Figure 2:
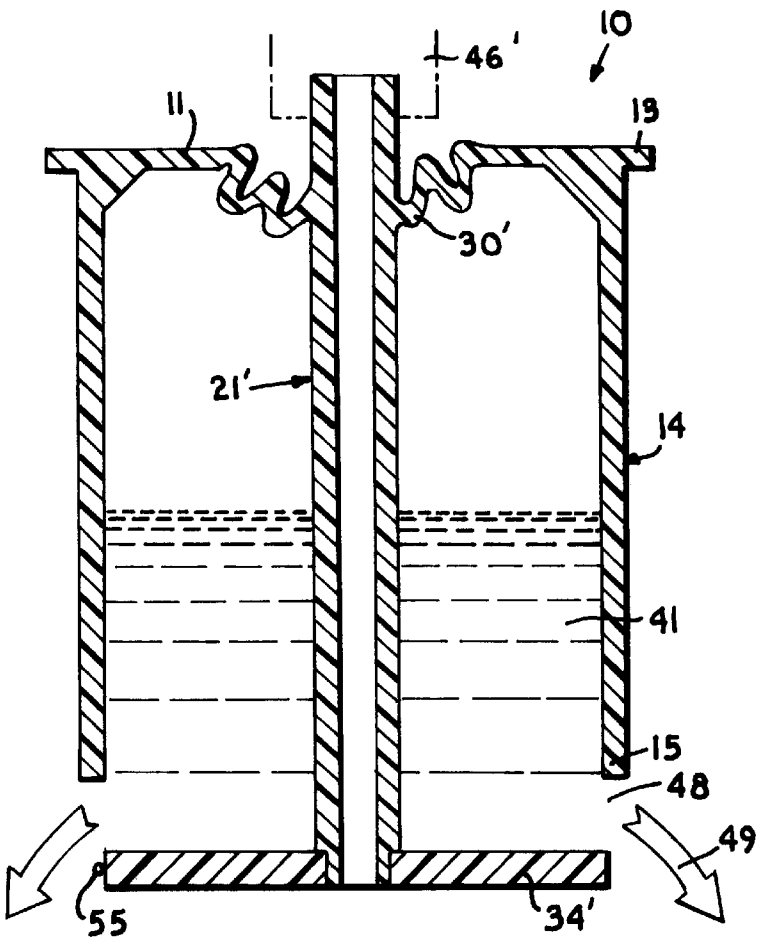
FIG. 2 shows the apparatus of FIG. 1, however, in a second operational position.

In the Figures reference numeral 10 designates a cartridge as is used in connection with a container for preparing a mixture of an active agent and a diluting agent.

Cartridge 10 is of essentially cylindrical design. It comprises an upper, essentially circular top plate 11. Top plate 11 comprises a center plane section 12 as well as an annular flange 13 at the outer periphery.

At its outer periphery plane section 12 integrally extends into a cylindrical wall 14 extending downwardly, that freely ends at a lower end 15 thereof.

A tube 21 extends along a center axis of cartridge 10. Tube 21 comprises an upper end 22 extending upwardly beyond top plate 11. Upper end 22 extends into an upper section 23 penetrating plane section 12 as will be described hereinafter. A middle section 24 of tube 21 extends parallel to the axis of cylindrical wall 14. A lower end 25 of tube 21 terminates essentially flush with lower end 15 of cylindrical wall 14. Lower end 25 may be provided with a turned outer groove 26.

As one can clearly see from the Figures, upper section 23 of tube 21 is connected to center plane section 12 of top plate 11 via a bellows 30, preferably integrally. This means that top plate 11, cylindrical wall 14 and the entire tube are preferably configured integrally, in particular as a commonly injected plastic material part.

A bottom plate 34 is plugged on lower end 25 of tube 21. Preferably, already-mentioned turned groove 26 is used for that purpose, the groove 26 being dimensioned such that bottom plate 34 may be shifted on lower end 25 of tube 21 with snug fit so that there is a sealed connection at this point.

An outer periphery 35 of essentially circular bottom plate 34 also runs tightly within an inner periphery 36 of cylindrical wall 14.

Figure 1:
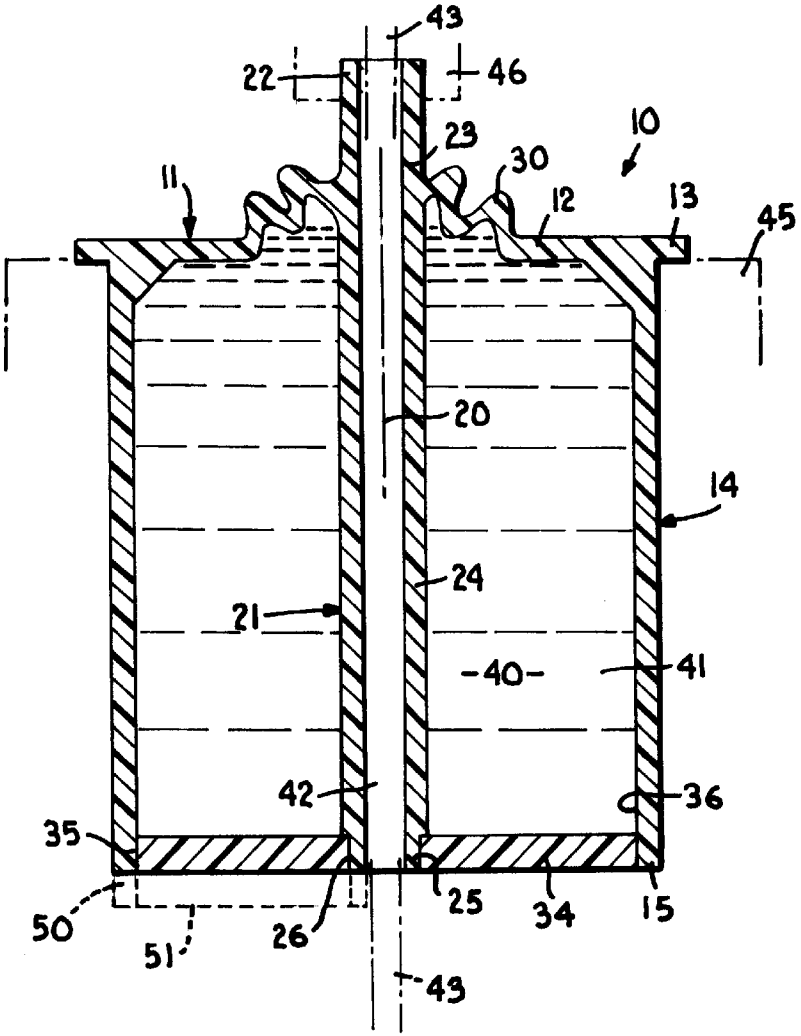
FIG. 1 is a side elevational and cross-sectional view of a art of an embodiment of the inventive apparatus, in a first operational position.

By the above-described arrangement an entirely tight arrangement is achieved in a first operational position according to FIG. 1, in which cartridge 10 has an interior 40 that may be filled with an active agent 41. Cartridge 10 is penetrated by a channel 42 extending along axis 20 due to the presence of tube 21. An ascending pipe 43 is guided through channel 42.

Cartridge 10 may now be placed on a container 45, a section of which being indicated in FIG. 1 as some type of bottleneck. For that purpose, cartridge 10 may be screwed-in by means of an outer thread on cylindrical wall 14 (not shown) or may be plugged-in or may be locked by means of a bayonet joint etc. Annular flange 13 serves for exactly positioning cartridge 10 on container 45.

A spray gun, for example, may be placed on the entire assembly, as indicated in FIG. 1 with reference numeral 46. Spray gun 46 is configured such that when it is lowered or screwed onto container 45, tube 21 is displaced in an axial direction. Spray gun 46 is connected to ascending pipe 43 in a manner known per se.

The second operational position, thus obtained, is depicted in FIG. 2. Like elements are identified with like reference numerals, however, different positions are indicated by the addition of an apostrophy.

As one can clearly see from FIG. 2, a downward displacement of spray gun 46 into position 46' concurrently effects an axial displacement of tube 21 into a position 21'.

Due to this displacement of tube 21 to 21', bellows 30 is deformed to 30'. The seal in the transition between tube 21 and top plate 11 remains, however, unaffected.

Downwardly displacing tube 21' concurrently serves as an actuator for bottom plate 34 being displaced to 34' in FIG. 2. Bottom plate 34, hence, acts as a piston within a cylinder configured by cylindrical wall 14. Now, if bottom plate 34 is displaced to 34', it comes out of contact with cylindrical wall 14 at its periphery because it is displaced beyond its lower end 15. Thus, an annular opening 48 is created through which active agent 41 may flow out as indicated by an arrow 49.

If bellows 30 is configured as a snap mechanism, the opening movement of tube 21 together with the bottom plate 34 may be increased. With commercially available spray guns for the application that is of interest here, the axial displacement during the screwing-on of the spray gun is only 2 mm, for example. If this movement is directly translated into the movement of bottom plate 34, this means that bottom plate 34, too, is displaced along a distance of 2 mm in the direction of axis 20. This, concurrently, limits the width of annular opening 48 given a certain thickness of bottom plate 34. If, in contrast, bellows 30 is configured as a snap mechanism, the relatively small axial movement of the spray gun during its screwing-on may be used for just getting over the "snap point" of the snap mechanism, i.e. the neutral position between the two snap end positions.

If the snap point has thus been overcome, tube 21 together with bottom plate 34 will snap farther below while it concurrently lifts off spray gun 46 with its upper end 22. The operational way of tube 21 together with bottom plate 34 is thus increased by this snap movement from the snap point down to the second, lower and stable end position of bellows 30.

FIG. 1 shows in dashed lines that according to a variation of the depicted embodiment the lower end 15 of cylindrical wall 14 may be extended beyond the position of bottom plate 34, as indicated by reference numeral 50. Lower end 25 of tube 21 is extended accordingly.

A protective foil 51 may be put on preferably extended ends 50 of cylindrical wall 14 and of tube 21 and may be welded-on on its respective circumferences. This has the effect that bottom plate 34 is entirely sealed so that even with very aggressive active agents 41 a flowing-out of the latter due to a leakage between bottom plate 34 and cylindrical wall 14 and tube 21, respectively, is avoided. Protective foil 51 is provided with an opening at axis 20 and ascending pipe 43 extends therethrough.

During the transition between first operational position according to FIG. 1 and second operational position according to FIG. 2 protective foil 51 is automatically destroyed through advancing bottom plate 34. For improving the sealing action at the outer periphery 35 of bottom plate 34 one may additionally provide an annular gasket 55 as indicated in FIG. 2.

I claim:

1. An apparatus for preparing a mixture of an active agent and a diluting agent, comprising a container for receiving said diluting agent and a cartridge for receiving said active agent within an interior of said cartridge, said interior being delimited by wall sections, said cartridge being adapted to be inserted into said container and being configured such that said active agent may be discharged from said interior into said container and diluted therein with said diluting agent, said cartridge, further, having a first wall section adapted to be at least partially disconnected from a surrounding second wall section, said first wall section being also connected to a third wall section via an actuator, said third wall section being separated from said first wall section by said second wall section, said actuator being rigidly connected to said third wall section at a fastening point thereof and said third wall section being configured flexibly in the area of said fastening point.

2. The apparatus of claim 1, wherein said third wall section is configured as a bellows in the area of said fastening point.

3. The apparatus of claim 1, wherein said third wall section is configured as an extensible diaphragm in the area of said fastening point.

4. The apparatus of claim 1 wherein said third wall section is configured as a snap mechanism taking a stable end position when said first wall section has been lifted off said second wall section.

5. The apparatus of claim 1 wherein said third wall section and said actuator are configured integrally.

6. The apparatus of claim 1 wherein said third wall section and said second wall section are configured integrally.

7. The apparatus of claim 1 wherein said actuator is configured as a tube penetrating said first wall section.

8. The apparatus of claim 1 wherein said first wall section is disconnectably connected to said actuator.

9. The apparatus of claim 1 wherein said first wall section is adapted to be plugged onto said actuator with a snug fit.

10. The apparatus of claim 1 wherein said first wall section is guided within said second wall section in a piston-type manner.

11. The apparatus of claim 1 wherein a foil (51) is provided, said foil entirely covering said first wall section and being rigidly connected at first periphery with said second wall section.

12. The apparatus of claim 1 wherein the cartridge is designed essentially cylindrically, said first wall section being configured as a bottom plate, said second wall section being configured as a cylindrical wall and said third wall section being configured as a top plate.

13. A method for filling a cartridge for an apparatus for preparing a mixture of an active agent and a diluting agent, comprising a container for receiving said diluting agent and said cartridge for receiving said active agent within an interior of said cartridge, said interior being delimited by wall sections, said cartridge being adapted to be inserted into said container and being configured such that said active agent may be discharged from said interior into said container and diluted therein with said diluting agent, said cartridge, further, having a first wall section adapted to be at least partially disconnected from a surrounding second wall section, said first wall section being also connected to a third wall section via an actuator, said third wall section being separated from said first wall section by said second wall section, said first wall section being detachably connected to said actuator and said interior, being freely accessible in the absence of said first wall section, being filled with said active agent and being thereafter closed by means of said first wall section.

14. A cartridge for receiving an active agent, comprising:

a first wall section;

a second wall section surrounding said first wall section and being connected to said first wall section in a first operational position, said first wall section, being, however adapted to be at least partially disconnected from said second wall section in a second operational position;

a third wall section, connected to said second wall section and being separated from said first wall section by said second wall section;

an actuator rigidly connected to said first wall section and connected to said third wall sections at a flexible area thereof;

wherein said actuator, when displaced relative to said second wall section, detaches said first wall section from said second wall section, thus allowing said active agent to be discharged from said cartridge, while said actuator remains connected to said flexible area of third wall section.

15. A hand-held apparatus for spraying a mixture of an active agent and a diluting agent comprising a bottle-like container, a manually operable spray gun on top of said container and a cartridge received within said container, said cartridge being filled with said active agent to be mixed with said diluting agent within said container, the cartridge having:

a first wall section;

a second wall section surrounding said first wall section and being connected to said first wall section in a first operational position, said first wall section, being, however adapted to be at least partially disconnected from said second wall section in a second operational position;

a third wall section, connected to said second wall section and being separated from said first wall section by said second wall section;

an actuator rigidly connected to said first wall section and connected to said third wall sections at a flexible area thereof;

wherein said actuator, when displaced relative to said second wall section, detaches said first wall section from said wall section, thus allowing said active agent to be discharged from said cartridge, while said actuator remains connected to said flexible area of third wall section.

* * * * *